US005471970A

United States Patent [19]

Sakarcan

[11] Patent Number: 5,471,970

[45] Date of Patent: Dec. 5, 1995

[54] METHOD OF MANUFACTURING A SEGMENTED DIAMOND BLADE

[75] Inventor: Metin Sakarcan, Columbia, S.C.

[73] Assignee: Diamant Boart, Inc., Kansas City, Mo.

[21] Appl. No.: 213,570

[22] Filed: Mar. 16, 1994

[51] Int. Cl.[6] ..... B28D 1/04

[52] U.S. Cl. ..... 125/15; 76/112; 228/233.2

[58] Field of Search ..... 51/206, 125, 15; 228/122.1, 193, 197, 198; 76/112, 115; 56/206 R, 206 P; 125/15

[56] References Cited

U.S. PATENT DOCUMENTS

| | | | |
|---|---|---|---|
| Re. 21,165 | 7/1939 | Van Der Pyl . | |
| 1,904,049 | 4/1933 | Hoyt . | |
| 2,189,259 | 2/1940 | Van Der Pyl . | |
| 2,270,209 | 1/1942 | Van Der Pyl . | |
| 2,405,086 | 7/1946 | Bevillard . | |
| 2,408,148 | 9/1946 | Longbotham . | |
| 2,467,596 | 4/1949 | Pratt . | |
| 2,818,850 | 1/1958 | Schwarzkopf et al. . | |
| 2,990,828 | 7/1961 | Hoerer | 76/112 |
| 3,048,160 | 8/1962 | Griffin et al. . | |
| 3,069,816 | 12/1962 | Pratt et al. . | |
| 3,369,879 | 2/1968 | Miller . | |
| 3,590,535 | 7/1971 | Benson et al. . | |
| 4,860,721 | 8/1989 | Matsuda | 76/112 |

FOREIGN PATENT DOCUMENTS

| | | | |
|---|---|---|---|
| 58-154476 | 4/1983 | Japan | 228/233.2 |
| 48606 | 6/1986 | Japan | 125/15 |
| 0293770 | 12/1986 | Japan | 125/15 |
| 0647085 | 2/1979 | U.S.S.R. | 228/233.2 |
| 1151384 | 4/1985 | U.S.S.R. | 76/112 |
| 1486304 | 6/1989 | U.S.S.R. | 228/233.2 |

OTHER PUBLICATIONS

Feduska, "An Evualuation of The Diffusion Bonding Characteristics of Ziroaloy–2", Jul. 1959.

"Diffusion in Solids" by Paul G. Shewmon of the Carnage Inst. of Tec., Dept. of Metallurgical Engineering, McGraw Hill Book Co., 1963.

*Primary Examiner*—Bruce M. Kisliuk

*Assistant Examiner*—Derris H. Banks

*Attorney, Agent, or Firm*—Kokjer, Kircher, Bowman & Johnson

[57] ABSTRACT

A method is provided for manufacturing a segmented diamond blade. The method includes the steps of placing a core into a mold and pouring a metal mixture into a mold cavity surrounding the core. The metal mixture is cold pressed to the core to form a blade having a continuous outer rim. Thereafter, the core and outer rim are suspended in a free-sintering furnace which is heated to an initial diffusion bonding temperature. The core and outer rim are heated for an initial bonding time period. Thereafter, the furnace is heated to a final diffusion bonding temperature and the core and outer rim are maintained at this temperature for a final diffusion bonding time period. After the blade cools, it is placed in a cutting tool and segmented. During segmentation, a plurality of radially aligned notches are cut through the outer rim and a corresponding plurality of gullets are cut in the core. During cutting, an inert gas, such as helium, argon or the like, is blown under high pressure directly onto the cutting point. The present method facilitates diffusion bonding and segmentation by using an optimal combination of metal particles to form the outer rim.

46 Claims, 1 Drawing Sheet

METHOD OF MANUFACTURING A SEGMENTED DIAMOND BLADE

BACKGROUND OF THE INVENTION

1. Field of the Invention

The present invention generally relates to a method for manufacturing a cutting blade having a hardened outer rim that is initially formed as a continuous outer rim diffusion bonded to a core which is then cut to produce a segmented blade.

2. Description of the Related Art

Cutting blades have been proposed that have hardened particles embedded in the outer rim to cut extremely hard surfaces, such as concrete, masonry and the like. These saw blades are rim typically formed with a steel core and a continuous or segmented rim embedded with the hardened particles, such as diamonds, tungsten carbide, polycrystalline diamond and the like (hereafter collectively referred to as "diamond particles").

In the past, methods have been proposed for manufacturing diamond blades which were dependent upon the configuration and function of the blade. These blades are separable into two primary types, blades formed with a continuous outer rim and blades formed with a segmented outer rim. Continuous rim blades are used in applications where chipping is critical, but blade speed is not, such as when cutting tile. Segmented rims are used in applications where chipping is not critical, but blade speed is critical, such as when cutting concrete. As the blade speed increases, typically, the operating temperature increases. If heated sufficiently, the outer segments will expand. The segments expand into the notches therebetween.

To construct a continuous rim blade, one method (U.S. Pat. No. 3,369,879) has been proposed in which an annular grinding member is affixed to a copper ring which is affixed to a steel core of the blade. The steel core is centered within a mold, the core's perimeter is coated with solder, the copper ring is pressed onto the core and bonded thereto with the solder. Next, a mixture containing diamond particles is poured into a cavity in the mold surrounding the copper ring. The mold is closed and heat and pressure are applied to the mixture to "hot press" the rim. This combination of heat and pressure forms a rigid grinding rim and secures the outer rim to the copper ring.

Alternative methods have been proposed for bonding the abrasive rim to the central core (U.S. Pat. Nos. 2,189,259; 2,270,209 and Reissue 21,165). In the method of the '259 patent, the core and the outer rim are separately poured into respective central and outer cavities of a mold. These cavities are separately closed and then aligned with one another and heated and compressed to hot press to the outer rim onto the core. In the method of the '209 patent, a steel central core is centered in the mold and the outer rim mixture is poured into a cavity surrounding this steel core. The mixture is hot pressed directly onto the core. In the method of the '165 reissue patent, the abrasive rim is welded or soldered to the central core.

The '879 patent, '209 patent, and '165 reissue patent are incorporated by reference.

As to the second type of blades, previous methods (U.S. Pat. No. 3,590,535) have been proposed to construct segmented outer rims. In the method of the '535 patent, a plurality of diamond bearing outer segments are formed from a mixture of diamond dust, copper powder and tin powder. Each outer segment is separately press molded onto a corresponding steel underlying segment. The steel underlying segments are machined to fit the contour of the core and subsequently welded thereto.

In an alternative method (U.S. Pat. No. 3,048,160) a blade for cutting hard materials is formed by initially molding a plurality of abrasive cutting segments. As originally formed, each segment includes a serrated bottom surface which is welded to the perimeter of the core by heating, and applying radial pressure against an outer surface of, each segment. An alternative method (U.S. Pat. No. 2,818,850) has been proposed in which the cutting segments are hot pressed such that the included diamond dust is concentrated near the outer surface of the cutting segment. Once hot pressed, an inner surface of the cutting segments are ground to provide a curved surface thereon which substantially corresponds to the outer arc of the blade core. Next, each segment is brazed to the disc core.

However, each of the above methods has only met with limited success. As to the latter group of methods, which separately fasten multiple segments to the core, each of these methods require separate and repeated handling of each segment. More specifically, each segment must be separately hot pressed. Next, each segment must be debarred along its outer surface and ground along its inner surface to form a concave surface thereon, the radius of which substantially corresponds to that of the steel core. Then, each segment must be separately bonded to the core.

Further, this latter group of methods experience extreme difficulty in bonding each segment to the steel core. The diamonds within each segment interfere with this bonding process. To overcome this problem, the '535 patent uses an underlying diamond face or backing layer molded to the diamond section and welded to the core. The '160 patent forms a serrated surface on each segment to effect bonding. The '850 patent utilizes a special molding technique to concentrate the diamond segments proximate the rim's outer surface.

The outer rims also create problems during welding steps since the welders are highly sensitive to the copper and diamond particles within the outer rim. When a welding beam contacts a copper particle, it is partially reflected and consequently less effective at heating the region of the abrasive segment surrounding the copper particle. Also, if the temperature of the welding beam is excessive and the beam contacts a diamond particle, the beam causes carbonization of the diamond particle. Ultimately, the carbonized diamond particle detaches from the segment. Diamond particles within the back side of each segment inhibit the radiusing process in which the concave surface on each segment is machined to match the core. To minimize the effects of the diamond particles upon the grinding and welding processes, a bonding or backing material is formed along the back side of the diamond segment. This backing material is easily ground to the desired radius and easily welded to the core.

Further, diamond blades formed by methods within the former group are void of notches within the core. These notches reduce heating of the blade and help clear foreign particles from the cut during operation. Consequently, blades formed by methods within the former group have more limited applications. If overheated, the continuous rims expand and often fail. Heretofore, it has been impossible to construct a segmented diamond blade without separately forming and securing each diamond segment to the core. The need remains in the industry for an improved method for manufacturing segmented diamond blades. The present invention is intended to meet this need, and to overcome drawbacks previously experienced.

SUMMARY OF THE INVENTION

It is an object of the present invention to provide a method for manufacturing cutting blades having a hardened segmented outer rim which removes the need to handle each segment separately and which reduces the number of steps within the manufacturing process.

It is another object of the present invention to provide a method for manufacturing diamond blades in which a continuous outer rim is diffusion bonded to a blade core and thereafter cut into segments.

It is another object of the present invention to facilitate the diffusion bonding process through which the outer rim is bonded to the core by utilizing at least one type of metal particles which undergoes densification.

It is another object of the present invention to eliminate the need to machine the inner surface of the diamond rim to conform to the outer curve of the core.

It is another object of the present invention to provide a method for manufacturing diamond blades which are easily cut with a cutting tool to cleanly cut notches through the outer rim and into gullets in the core.

It is another object of the present invention to provide a method for manufacturing diamond blades which uses a laser cutting beam having a narrow width and which utilizes an inert gas blown into the cut to avoid air oxidation therefrom.

It is another object of the present invention to facilitate the cutting of notches through the outer diamond rim by forming the outer rim from a mixture of metal bonding agents and diamond particles which is easily cut with a laser beam.

Other and further objects of the invention, together with the features of novelty or pertinent thereto, will appear in the detailed description set forth below.

In summary, a method is provided for manufacturing a blade having a diamond impregnated outer rim. The method includes the steps of placing a core into a mold and pouring a metal diamond mixture into a mold cavity surrounding the core. The metal diamond mixture is cold pressed to the core to form a blade having a continuous outer rim. Thereafter, the core and outer rim are stacked in a free-sintering furnace which is heated to an initial diffusion bonding temperature. Thereafter, the furnace is heated to a final diffusion bonding temperature and the core and outer rim are maintained at this temperature for a final diffusion bonding time period. After the blade cools, it is placed in a cutting tool and segmented. During segmentation, a plurality of radially aligned notches are cut through the outer rim and a corresponding plurality of gullets are cut in the core. During cutting, oxygen gas is used. The present method facilitates diffusion bonding and segmentation processes thereafter.

BRIEF DESCRIPTION OF THE DRAWINGS

In the following description of the drawings, in which like reference numerals are employed to indicate like parts in the various views.

DETAILED DESCRIPTION OF THE INVENTION

Figure 1:
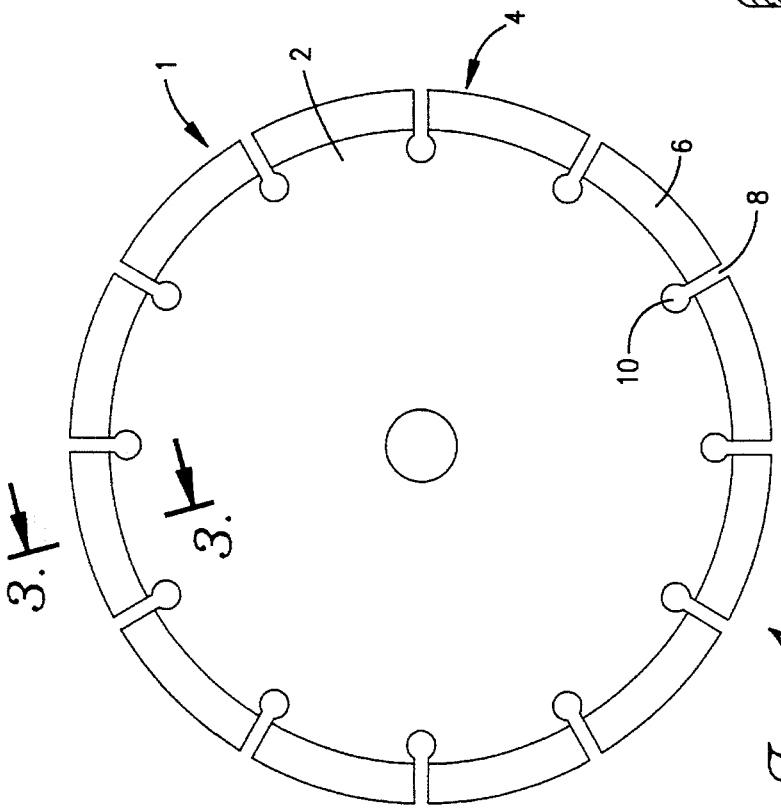
FIG. 1 is a side elevational view of a diamond blade resulting from the inventive method.

FIG. 1 illustrates a diamond blade generally designated by the reference numeral 1 which is produced by the present method. The diamond blade 1 includes a disc-shaped core 2 formed of a hard material, such as steel and the like. The core 2 is surrounded by an outer rim 4 that is separated into a plurality of segments 6 having notches 8 therebetween. The notches 8 extend radially toward the center of the blade 1 and are formed with circular gullets 10 at an innermost end thereof. Optionally, the gullets 10 could be formed with another shape, such as a U-shape, V-shape, and the like. The blade 1 is produced in accordance with the following process. As the inventive method utilizes conventional machines to perform the molding, heating and cutting operations, these machines are not illustrated specifically.

According to the preferred embodiment, a mold is used to cold press a continuous outer rim 14 (FIG. 2) onto the core 2. The mold includes a base having a centering pin thereon for receiving a central hole 18 of the core 2. The centering pin centers the core 2 within the mold such that an outer periphery 20 of the core 2 is positioned proximate a circular void within the mold. The mold includes a bottom support which supports the core 2 and a top support which is received upon the core 2. The bottom and top supports include outer peripheries which substantially aligns with the outer periphery 20 of the core 2. Once the core 2 and the top support are inserted into the mold, they cooperate to form the circular void which is filled with a bond powder.

The bond powder is formed from a mixture of metal particles and hardened particles. The hardened particles may be diamonds, tungsten carbide, polycrystalline diamond and the like. The metal particles may be phosphorus, zinc, antimony, iron, nickel, cobalt, silver, copper, tin and the like which interact to form alloys. The composition of the bond powder may be varied so long as it remains compatible with the methods explained hereafter. These metals are chosen to serve a variety of goals, including the provision of a dense hard outer rim, a strong bond between the outer rim and core and an outer rim that is evenly cut. To maximize the results of the instant method, the composition of the metal powder must be compatible with desired diffusion bonding and cutting techniques.

The bond powder may include first and second metals which diffusion bond with one another to form bronze, brass or a similar alloy (e.g., copper and tin or zinc and tin) and a third metal (e.g., nickel, cobalt) that diffusion bonds (sinters) with the bronze or brass to form an extremely dense composite alloy. Also, the bond powder may include a fourth metal (e.g., silver or nickel alloy) which serves as a "wetting agent" to facilitate diffusion bonding between the outer rim and the core. In the following example, a particular bond powder composition is discussed only by way of example.

Figure 2:
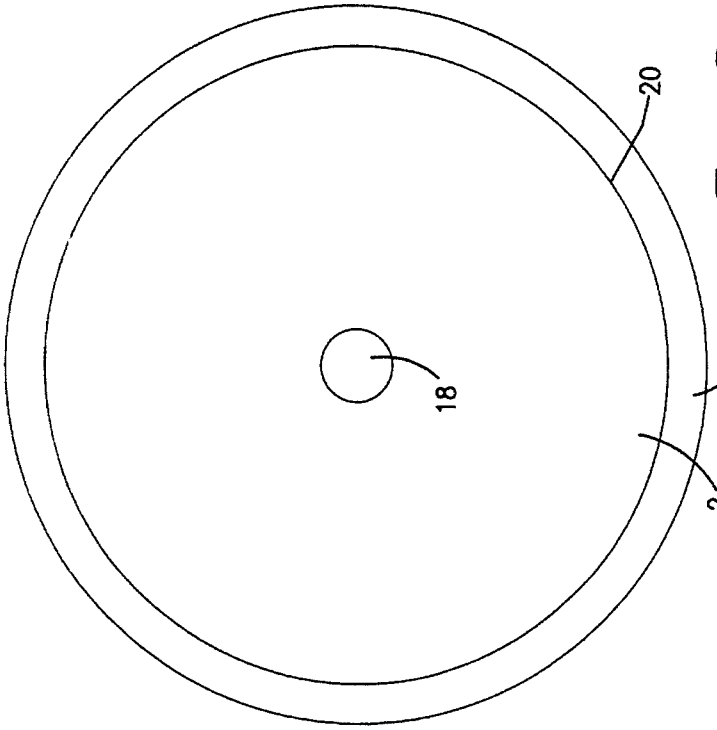
FIG. 2 is a side elevational view of a diamond blade at an intermediate step within the present method, after the diamond rim has been diffusion bonded onto the core.
Figure 3:
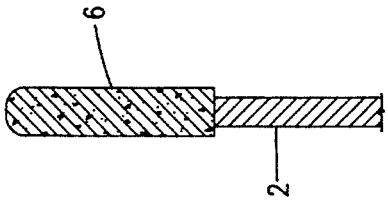
FIG. 3 illustrates a side sectional view along line 3—3 in FIG. 1 of a diamond blade formed by the present method.

A bond powder is formed which may, by way of example only, comprise diamond, tin, copper, silver and nickel particles. The tin, copper, silver and nickel have melting points of approximately 450° F., 1980° F., 1760° F. and 2600° F., respectively. The bond powder is poured into the circular void, the mold is closed and the circular void is compressed upon itself and toward the core 2. The mold cold presses (e.g., no heat is applied) the void to compact the bond powder into an outer rim having a density of approximately 65% of its maximum attainable density. The cold pressing technique also momentarily secures the bond powder to the core 2. At this stage, the blade includes a core 2 surrounded by a continuous outer rim 14, which is illustrated in FIG. 2. A variety of alternative methods exist for initially forming the outer rim upon the core, prior to achieving densification through diffusion bonding. For instance, the outer rim may be formed by hot pressing, rapid solidification, injection molding and free sintering, hot isostatic pressing (e.g., application of pressurized gas), coining, forging, and the like, so long as the method provides a continuous rim which may be diffusion bonded to the core. Alternatively, the outer rim may be extruded onto the core, cold pressed and then hot pressed, hand filled and then hot pressed, microwave centered, hand-filled and then infiltrated with liquid metal and the like.

In the preferred embodiment, the cold pressed blade is removed from the mold and placed in a furnace for free (pressureless) sintering to achieve further densification. Densification can be achieved by hot pressing the powder bond to the core to produce diffusion bonding internally within the outer rim between the metal particles therein. Optionally, the blade may be placed in a hot press sintering (pressurized) furnace, and the like. Densification through diffusion bonding also occurs between the outer rim 14 and the core 2 thereby mounting the outer rim 14 permanently upon the core 2. The blade 1 is furnaced between 2 and 8 hours at a temperature preferably not to exceed 2000° F. The sintering time and temperature varies based on the single metal or combination of metals within the bond powder. During an initial stage of sintering the furnace is heated to a temperature, at which the first and second metals (e.g., tin, zinc, copper, etc.) combine to form a bronze or brass alloy. The melting point of copper or zinc is then reduced to a point between 1400° F. and 1600° F., which will vary depending upon the percentage of tin and copper, tin and zinc, etc., within the bond powder.

After the initial sintering phase, if metals such as nickel, cobalt, silver and similar alloys are present, the furnace temperature is increased to 1600° F.–2000° F., at which it is maintained for a final densification process of soaking such as for 2 hours. When heated to this higher temperature, silver, nickel, cobalt and similar alloy metals melt and flow through the bond powder to increase densification. These alloys are chosen for their characteristics as a "wetting agent" to facilitate diffusion bonding between the bond powder and the outer periphery of the core. As the partially liquid bronze or brass and silver elements interact with other metals (e.g., iron, cobalt, nickel, etc.) densification of the entire system is achieved through liquid phase sintering. This allows the shrinkage of metal around diamond particles as gullet as the ring around the metal disc. While the diamond containing rim section is shrinking over the disc, the diffusion enhanced metallurgical bonding process further strengthens the rim to core interface.

Throughout the diffusion bonding process, the hard particles (e.g., diamonds) remain evenly distributed through the bond powder and the outer rim. The diffusion bond within the bond powder and between the bond powder and the metal core varies in depth and density depending upon the time, temperature and pressure. The atoms within the bond powder and metal core move and interlock during diffusion bonding. The amount of movement determines the depth of the bond. Thus, as the temperature and pressure within the furnace vary, so does the depth of the diffusion bond. The depth and density of the diffusion bond into the core also dependent upon the diffusion coefficients of the core and each metal within the metal powder. Thus, the longer that the blade is held within the furnace, the denser the diffusion bond.

The furnace temperature must be carefully selected and maintained throughout diffusion bonding to prevent the formation of localized pockets or voids within the outer rim. The number of voids within the bond powder is referred to as its porosity.

Further, if the furnace temperature is raised too high during the final diffusion bonding phase, this heat will detrimentally effect the diamond particles within the outer rim, such as through graphitization and the like.

Diffusion bonding may be achieved through a variety of methods, such the interstitial mechanism, the vacancy mechanism, substitutional and the like. These and other diffusion bonding techniques compatible with the present method, are disclosed in a text book entitled "Diffusion in Solids" by Paul G. Shewmon of the Carnage Inst. of Tech., Dept. of Metallurgical Engineering, McGraw Hill Book Co., 1963, which is incorporated by reference. Similarly, a variety of devices may be used to achieve diffusion bonding, such as a hot press sintering (pressurized furnace) and the like. The use of a free-sintering furnace is by way of example only. Further, the furnace may be heated to a single temperature and maintained therethrough, so long as diffusion bonding is achieved. The type of device used to achieve diffusion bonding will also depend on the type and number of materials in the bond powder.

By way of example, a hot sintering press may be used to achieve a diffusion bond, which is heated to a single temperature and is induced with a single pressure. The heat time and pressure may be varied so long as a diffusion bond is achieved.

To facilitate the diffusion bonding process, it is also preferable to use materials (e.g., bronze, copper, silver and nickel) within the bond powder having close melting points. Alternatively, a single material may be used for the bond powder, such as nickel or cobalt.

Once the densification process is complete, the furnace is shut down and left to cool. During the cooling process the densified diamond rim section contracts. As it contracts the outer rim provides an enhanced mechanical/physical interlocking mechanism with the peripheral portion of the core which has undergone diffusion bonding. The density may increase/change by 30–40% (during the densification process) from its original cold pressed density. Hence, the dimensions of the outer rim will shrink. If the height of the outer rim, when cold pressed, is approximately 0.200", its final height, after diffusion bonding, will equal roughly 0.180". Similarly, if the width of the cold pressed outer rim equals 0.8", it will contract to roughly 0.7" after diffusion bonding. The diffusion bonded region which includes the metal powders and steel particles from the core represents the strongest portion of the blade. However, all pores or voids must be removed from this region (also referred to as the bonding interface) to prevent premature failure.

However, if the outer rim is formed with localized pockets of non-bonded metal particles, these pockets are less dense than the diffusion bonded regions.

Once the blade is cooled, it is transferred to a cutting tool, such as laser cutter, water beam cutter, plasma arc cutter, electron beam cutter and the like. Alternatively, the blade may be transferred to a punch tool for punching out the segment notches and/or gullets or slots. The tool cuts or punches out each notch 8 through the outer rim 4 and/or each gullet 10 within the core 2 (FIG. 1). Here again, the types of metals, and percentages thereof, must be selected to ensure that the tool is able to perform a smooth and fast cut or punch.

By way of example, the cutting tool may constitute a laser beam cutter of the type disclosed in an article entitled "Investigations in Optimizing The Laser Cutting Process" by F. O. Olsen, which is incorporated by reference. The laser beam cutter includes a lens for focusing a laser beam onto the blade. Below the lens, is formed a gas chamber into which pressurized gas is introduced and directed onto the blade. The laser beam cutter includes a bale located on a bottom side thereof to define a lower region of the gas chamber. The bale includes a nozzle tip having a thickness $N_a$ and an outer diameter $N_d$. The nozzle tip includes a nozzle aperture therethrough and in the center thereof having an outer diameter $N_d$. The nozzle tip is located a distance $N_h$ from the region of the blade being cut.

During operation, the nozzle height $N_h$ is continuously adjusted to maintain an optimal height between the cutting tool and the blade. For best results, the diameter $N_d$ of the nozzle aperture is maintained large in comparison to the nozzle distance $N_h$ between the nozzle and the blade. This is preferable to direct the gas beam into the cut curve. When the ratio $N_d \backslash N_h$ is large, the gas pressure decrease from the nozzle tip down to the cut curve. Further, when this ratio is large, it allows pressure variations along the distance between the nozzle tip and the diamond blade. These pressure variations may cause lensing effects which may disturb the laser beam. Hence, it is preferable that the ratio $N_d \backslash N_h$ remain large, such as $N_d \backslash N_h \geqq 2$. This ratio maintains a negligible pressure variation between the nozzle tip and the diamond blade, thereby avoiding lensing effects and increasing the gas pressure within the cut curve. When the ratio $N_d \backslash N_h$ is large, the nozzle tips outer diameter $N_d$ effects the gas flow. When this outer diameter $N_d$ increases for a given nozzle height $N_h$, the gas flow along the outer surface of the diamond blade and the nozzle tip decreases.

The laser beam utilized in the preferred embodiment is polarized and directs a stream of pressurized gas onto the cut kerf, in order to obtain maximum cutting efficiency from the cutting tool. By way of example, the beam may be polarized in a direction parallel to the cutting direction. The polarization of the laser beam effects the cutting rate of the laser and causes variations in the geometry of the cut curve. When the cutting tool is used to cut materials with a low reflectivity for normally incident light, the effects of the laser polarization are not noticeable. Hence, it is preferable to use metals which diffusion bond to one another to form a composition having low reflectivity. Compositions which are highly reflective reflect the laser beam away from the cut kerf and inhibit its propagation through the blade.

Adjusting the gas pressure also varies the cutting rate and quality. At extremely low pressures, high quality cuts are difficult to obtain while maintaining a desired cutting rate. The cutting rate may be increased when the beam pressure is increased to an intermediate level. At extremely high pressure values, burning effects are encountered in the bottom of the cut which impede the quality of the cut. Optionally, if a desired pressure is unattainable, the outer diameter $N_d$ of the nozzle tip may be increased to achieve the same effect as high pressures within the cutting zone. The dynamic behavior of the laser beam cutter causes the formation of striations (e.g., grooves or rough surfaces) within the cut curve.

The cutting rate is primarily dictated by the rate at which the cutting tool is able to penetrate and progress through the entire thickness of the blade (e.g., the outer rim and core). The cutting rate may not exceed the rate at which the cutting tool is able to cut the densest and hardest metal compound within the outer rim. The smoothness of the cut will be dictated by the uniformity of the bond powder and the pores therein (i.e., percentage of voids). This is due partially to the fact that when a laser beam encounters a void or pore in the material being cut, the laser erratically jumps this void. Also, the voids typically contain gas pockets. When the laser beam encounters the gas pocket, the gas is turbulently discharged from the pocket. The uneven laser jumping motion and the gas discharges create uneven regions along the kerf of the cut (also referred to as "blow holes). Therefore, as the densification and uniformity of the bond powder is increased and the porosity decreased, the smoothness of the cut kerf is increased.

However, when complete diffusion bonding occurs, the outer rim exhibits a somewhat homogeneous bronze-nickel-silver alloy composition throughout. This alloy composition melts substantially evenly. Every region within the alloy composition does not melt at exactly the same instant since partial or localized melting is controlled by the percentage of the content of the lower melting point elements within the local region of the alloy. However, the diffusion bonded particles within a localized region of the alloy composition melts proximate one another and within a substantially small temperature and time range. Thus, if the alloys are uniformly formed along the cutting surface within the cut kerf, it will melt at approximately the same time as it is exposed to the cutting beam. Hence, the cutting beam is able to melt the alloys along the entirety of the cutting surface within a short period of time, blow the melted alloy composition from the cut kerf and move the beam while the alloy composition is still molten.

However, the cutting operation is not as smooth when the metal particles through out the outer rim are not properly diffusion bonded. Cutting quality is related to the ratio of the bronze or brass content to that of other alloys. When the copper/bronze/brass content is greater than 20%–50% of the overall composition, then the cutting quality is reduced. As noted above, when executed improperly, localized regions of copper and nickel are formed within the outer rim during diffusion bonding. The melting point of copper is somewhat less than that of nickel. When the cutting tool encounters a copper region, it melts this region quite rapidly, much faster than it is able to melt any surrounding nickel regions. Thus, the cutting tool must remain at a particular location while it melts the nickel. As the cutting tool remains focused on the nickel region, it continues to transmit heat to the neighboring copper region. Hence, copper along side the cut kerf is melted. This copper ultimately flows away from the cutting tool, cools and solidifies. The region of displaced copper or bronze leaves a void or recess in the outer rim which is wider than the surrounding cut kerf. Also, the large region of displaced copper solidified on the surface of the outer rim or within the cut kerf thereby forming an irregularity on the blade (referred to as a "bubble"). Also, the pocket of liquid copper may surround a diamond particle. Thus, as the copper is displaced, it weakens the support for the diamond which may also become dislodged and create an even bigger void (referred to as a "blow hole").

Thus, to avoid bubbles and blow holes, it is important that the diffusion bonding step form a dense, non-porous and somewhat homogeneous metal alloys throughout the outer rim.

Further, to maximize the use of a laser beam as the cutting tool, the diffusion bonded alloys within the outer rim must be relatively non-reflective. When the laser beam contacts reflective materials, a portion of the beam is reflected which reduces the effective cutting power of the laser. Copper is highly reflective, while the bronze-silver-nickel composition is less reflective. Therefore, when localized pockets of copper are formed within the outer rim, these pockets reflect a large portion of the laser beam. This reflection reduces the effective cutting power of the laser.

Also, the bronze-nickel-silver alloy composition has a lower melting point than the nickel. Thus, the temperature necessary to cut the bronze-nickel-silver alloy composition is less than that necessary to cut nickel. Thus, the compositional uniformity impacts the cutting temperature.

While the above example discusses the use of tin, copper, silver and nickel, it will be understood that the present invention is not limited to use with these materials. Instead, any materials may be used so long as they form a composition that is compatible with the cutting tool. Further, a single type of metal may be used to construct the bond powder. A bond powder formed of a single type of metal may be hot pressed around a core that is plated with copper, tin, and zinc (e.g., bronze or brass) to achieve diffusion bond of the powder metal to the core while densifying the bond powder.

In an alternative embodiment, the core 2 is initially formed with the circular gullets 10 therein spaced about its circumference. The core 2 with the gullets 10 therein is placed in the cold press and then in the bell furnace as explained above. Thereafter, the cutting step merely needs to cut the notches 8 through the outer rim 4 into the core 2 to the circular gullets 10. The circular gullets 10, which may be formed as pre-existing holes, serve as heat sinks to avoid cracking during use.

The following examples illustrate the percentages of metals which may be used, the heating temperatures and the heating times.

EXAMPLE

| Metal | percentage |
|---|---|
| Cobalt | 20–50% |
| Nickel | 10–70% |
| Iron | 10–50% |
| Copper and Tin | 10–50% |
| Silver | 2–20% |
| Heating Time at First Temperature | 1–5 hrs |
| First Heating Temperature | 1400 |
| Heating Time at Second Temperature | 1–5 hrs |
| Second Heating Temperature | 1750 |
| Cooling Time | 4 hrs |

From the foregoing it will be seen that this invention is one gullet adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings 1–3 is to be interpreted as illustrative, and not in a limiting sense.

What is claimed is:

1. A method for producing a cutting blade having a core and a segmented outer rim comprising the steps of:

introducing a bond powder mixture onto said core to form a continuous uninterrupted outer rim, said bond powder mixture including metal particles and hardened cutting particles;

after said introducing step, bonding said core to said continuous uninterrupted outer rim by heating said continuous uninterrupted outer rim and said core to a preselected temperature; and after said bonding step, forming notches through said continuous uninterrupted outer rim to remove portions of said outer rim and portions of said core to form a segmented outer rim.

2. A method for producing a cutting blade according to claim 1, further comprising the step of:

forming a bond powder comprising first and second metals which bond to form a bronze or brass compound, a third metal which functions as a wetting agent, and a fourth metal which bonds to said bronze compound and said wetting agent.

3. A method for producing a cutting blade according to claim 1, further comprising the step of:

forming a bond powder comprising at least three types of metal that will bond with one another and with said core.

4. A method for producing a cutting blade according to claim 1, further comprising the step of:

forming a bond powder comprising at least two types of metal that will bond with one another and with said core, and at least one type of hardened particles for cutting.

5. A method for producing a cutting blade according to claim 1, further comprising the step of:

forming a bond powder comprising at least one type of metal that will bond with one another and with said core, and diamond particles for cutting.

6. A method for producing a cutting blade according to claim 1, wherein said bonding step further includes the steps of:

heating said core and outer rim to an initial bonding temperature for an initial bonding time period, and thereafter, heating said core and outer rim to a final bonding temperature for a final bonding time period.

7. A method for producing a cutting blade according to claim 1, wherein said bond powder comprises at least first and second metals and said bonding step further includes the step of:

bonding said first and second metals to one another by heating said core and outer rim to an initial bonding temperature which is above a melting point of said first metal and below a melting point of said second metal during an initial bonding time period.

8. A method for producing a cutting blade according to claim 1, wherein said bond powder comprises at least first and second metals bonded to one another to form a bonded alloy and a third metal, said bonding step further includes the step of:

bonding said bonded alloy and said third metal with one another by heating said core and outer rim to a final bonding temperature, which is above a melting point of said bonded alloy and below a melting point of said third metal, during a final bonding time period.

9. A method for producing a cutting blade according to claim 7, wherein said bond powder comprises at least a third metal and wherein said bonding step further comprises the step of:

bonding said third metal and a diffusion bonded alloy formed by said first and second metals by heating said core and outer rim to a final bonding temperature, which is above said initial bonding temperature, during an initial bonding time period.

10. A method for producing a cutting blade according to claim 9, wherein said final bonding temperature is below a melting point of said third metal.

11. A method for producing a cutting blade according to claim 1, wherein said introducing step further comprises the step of:

centering said core within a mold and pouring said bond powder mixture into a void surrounding said core; and cold pressing said bond powder mixture to obtain approximately 65% compression thereof with respect to a maximum compression.

12. A method for producing a cutting blade according to claim 1, wherein said bonding step is free-sintering while densification and bond shrinkage occur.

13. A method for producing a cutting blade according to claim 1, wherein said bond powder includes at least two metals and wherein said core and outer rim are heated during said bonding step to a temperature between melting points of said two metals.

14. A method for producing a cutting blade according to claim 1, wherein said bonding step includes the steps of:

initially heating said core and outer rim to a temperature between 1400° F. and 1600° F. to effect initial bonding; and finally heating said core and outer rim to a temperature between 1600° F. and 2000° F. to effect final bonding.

15. A method for producing a cutting blade according to claim 1, wherein said introducing step further comprises the step of:

hot pressing said bond powder mixture to obtain partial compression thereof.

16. A method for producing a cutting blade according to claim 1, wherein said introducing step further comprises the step of:

performing rapid solidification of said bond powder mixture to obtain partial compression thereof and adhesion to said core.

17. A method for producing a cutting blade according to claim 1, wherein said introducing step further comprises the step of:

sintering of said bond powder mixture to obtain partial compression thereof and adhesion to said core.

18. A method for producing a cutting blade according to claim 1, wherein said introducing step further comprises the step of:

microwave sintering of said bond powder mixture to obtain partial compression thereof and adhesion to said core.

19. A method for producing a cutting blade according to claim 1, wherein said introducing step further comprises the step of:

hot isostatically pressing said bond powder mixture to obtain adhesion to said core.

20. A method for producing a cutting blade according to claim 1, wherein said introducing step further comprises the step of:

coining said bond powder mixture to obtain adhesion to said core.

21. A method for producing a cutting blade according to claim 1, wherein said introducing step further comprises the step of:

forging said bond powder mixture to obtain adhesion to said core.

22. A cutting blade having a circular core with an outer periphery having gullets formed thereabout and with a continuous outer rim thereon, said continuous outer rim having notches therein proximate said gullets, said blade being formed by a method comprising the steps of:

introducing a bond powder mixture onto said core to form a continuous uninterrupted outer rim, said bond powder mixture including metal particles and hardened cutting particles;

after said introducing step, bonding said core to said continuous uninterrupted outer rim by heating said continuous uninterrupted outer rim and said core to a preselected temperature; and after said bonding step, forming notches through said continuous uninterrupted outer rim to remove portions of said outer rim and portions of said core to form a segmented outer rim.

23. A cutting blade formed by the method of claim 22, further comprising the step of:

forming a bond powder comprising first and second metals which bond to form a bronze compound, a third metal which functions as a wetting agent, and a fourth metal which bonds to said bronze compound and said wetting agent.

24. A cutting blade formed by the method of claim 22, further comprising the step of:

forming a bond powder comprising at least three types of metal that will bond with one another and with said core.

25. A cutting blade formed by the method of claim 22 comprising the step of:

forming a bond powder comprising at least two types of metal that will bond with one another and with said core, and at least one type of hardened particles for cutting.

26. A cutting blade formed by the method of claim 22, further comprising the step of:

forming a bond powder comprising at least one type of metal that will bond with one another and with said core, and diamond particles for cutting.

27. A cutting blade formed by the method of claim 22 wherein said bonding step further includes the steps of:

heating said core and outer rim to an initial bonding temperature for an initial bonding time period, and thereafter, heating said core and outer rim to a final bonding temperature for a final bonding time period.

28. A cutting blade formed by the method of claim 22, wherein said bond powder comprises at least first and second metals and said bonding step further includes the step of:

bonding said first and second metals to one another by heating said core and outer rim to an initial bonding temperature which is above a melting point of said first metal and below a melting point of said second metal during an initial bonding time period.

29. A cutting blade formed by the method of claim 22, wherein said bond powder comprises at least first and second metals bonded to one another to form an alloy and a third metal, said bonding step further includes the step of:

bonding said bonded compound and said third metal with one another by heating said core and outer rim to a final bonding temperature, which is above a melting point of said alloy and below a melting point of said third metal, during a final bonding time period.

30. A cutting blade formed by the method of claim 22, wherein said bond powder comprises at least a third metal and wherein said bonding step further comprises the step of:

bonding said third metal and a bonded compound formed by said first and second metals by heating said core and outer rim to a final bonding temperature, which is above said initial bonding temperature, during an initial bonding time period.

31. A cutting blade formed by the method of claim 30, wherein said final bonding temperature is below a melting point of said third metal.

32. A cutting blade formed by the method of claim 31, wherein said introducing step further comprises the step of:

centering said core within a mold and pouring said bond powder mixture into a void surrounding said core; and cold pressing said bond powder mixture to obtain approximately 65% compression thereof with respect to a maximum compression.

33. A cutting blade formed by the method of claim 22, wherein said bonding step is free-sintering while densification and bond shrinkage occur.

34. A cutting blade formed by the method of claim 22, wherein said bond powder includes at least two metals and wherein said core and outer rim are heated during said diffusion bonding step to a temperature between melting points of said two metals.

35. A cutting blade formed by the method of claim 22, wherein said bonding step includes the steps of:

initially heating said core and outer rim to a temperature between 1400° F. and 1600° F. to effect initial bonding; and finally heating said core and outer rim to a temperature between 1600° F. and 2000° F. to effect final bonding.

36. A method for producing a cutting blade according to claim 22, wherein said introducing step further comprises the step of:

hot isostatically pressing said bond powder mixture to obtain adhesion to said core.

37. A method for producing a cutting blade according to claim 22, wherein said introducing step further comprises the step of:

coining said bond powder mixture to obtain adhesion to said core.

38. A method for producing a cutting blade according to claim 22, wherein said introducing step further comprises the step of:

forging said bond powder mixture to obtain adhesion to said core.

39. A method for producing a cutting blade according to claim 1, wherein said harden cutting particles include diamond particles.

40. A cutting blade according to claim 22, wherein said hardened cutting particles include diamond particles.

41. A cutting blade formed by the method of claim 22, wherein said hardened cutting particles include diamond particles.

42. A method for producing a cutting blade having a core and a segmented outer rim comprising the steps of:

introducing a bond powder mixture onto said core to form a continuous outer rim;

bonding said core to said continuous outer rim by heating said continuous outer rim and said core to a preselected temperature, wherein said bonding step includes the steps of, heating said core and outer rim to an initial bonding temperature for an initial bonding time period; and thereafter, heating said core and outer rim to a final bonding temperature for a final bonding time period; and forming notches through said continuous outer rim to remove portions of said outer rim and portions of said core to form a segmented outer rim.

43. A method for producing a cutting blade having a core and a segmented outer rim comprising the steps of:

introducing a bond powder mixture onto said core to form a continuous outer rim;

bonding said core to said continuous outer rim by heating said continuous outer rim and said core to a preselected temperature; and forming notches through said continuous outer rim to remove portions of said outer rim and portions of said core to form a segmented outer rim, wherein said bond powder includes at least two metals and wherein said core and outer rim are heated during said bonding step to a temperature between melting points of said two metals.

44. A cutting blade comprising:

a circular core having an outer periphery with a continuous outer rim press molded thereon, said outer rim being formed from a bond powder mixture including at least two types of metal particles and at least one type of hardened cutting particles, said at least two types of metal particles being bonded to one another, said continuous outer rim having an innermost region proximate said outer periphery of said core in which said at least two types of metal particles are bonded to said outer periphery of said core, said continuous outer rim having a plurality of radially aligned notches cut therethrough to segment said continuous outer rim, wherein said two types of metal particles are bonded to one another by heating said outer rim to an initial bonding temperature which is between melting points of said two types of metal particles.

45. A cutting blade comprising:

a circular core having an outer periphery with a continuous outer rim press molded thereon, said outer rim being formed from a bond powder mixture including at least one type of metal particles and at least one type of hardened cutting particles, said at least one type of metal particles being bonded to one another, said continuous outer rim having an innermost region proximate said outer periphery of said core in which said at least one type of metal particles are bonded to said outer periphery of said core, said continuous outer rim having a plurality of radially aligned notches cut therethrough to segment said continuous outer rim, wherein bonded metal particles in the outer rim form a substantially non-porous homogeneous alloy compound which, when cut, substantially evenly melts along a cut kerf to form the said notches.

46. A cutting blade having a circular core with an outer periphery having gullets formed thereabout and with a continuous outer rim thereon, said continuous outer rim having notches therein proximate said gullets, said blade being formed by a method comprising the steps of:

introducing a bond powder mixture onto said core to form a continuous outer rim;

bonding said core to said continuous outer rim by heating said continuous outer rim and said core to a preselected temperature; and cutting notches through said continuous outer rim to remove portions of said outer rim and portions of said core to form a segmented outer rim, wherein said bond powder includes at least two metals and wherein said core and outer rim are heated during said bonding step to a temperature between melting points of said two metals.

* * * * *